US010948845B1

(12) United States Patent
Mizuta

(10) Patent No.: US 10,948,845 B1
(45) Date of Patent: Mar. 16, 2021

(54) IMAGE FORMING UNIT AND IMAGE FORMING APPARATUS

(71) Applicant: TOSHIBA TEC KABUSHIKI KAISHA, Tokyo (JP)

(72) Inventor: Katsunori Mizuta, Yokohama Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/824,851

(22) Filed: Mar. 20, 2020

(51) Int. Cl.
*G03G 15/08* (2006.01)
*G03G 15/09* (2006.01)

(52) U.S. Cl.
CPC ..... *G03G 15/081* (2013.01); *G03G 15/0855* (2013.01); *G03G 15/09* (2013.01)

(58) Field of Classification Search
CPC ... G03G 15/081; G03G 15/09; G03G 15/0855
See application file for complete search history.

(56) References Cited

U.S. PATENT DOCUMENTS 4,951,091 A * 8/1990 Nawata ..... G03G 15/0849 399/27
2009/0010683 A1* 1/2009 Morimoto ..... G03G 15/0812 399/276

FOREIGN PATENT DOCUMENTS

CN 205210516 5/2016

* cited by examiner

*Primary Examiner* — G.M. A Hyder
(74) *Attorney, Agent, or Firm* — Amin, Turocy & Watson, LLP

(57) ABSTRACT

According to one embodiment, there is provided an image forming unit including: an image carrier; a charger; a latent image forming unit; a developing roller; and a regulating member. The charger charges the image carrier. The latent image forming unit forms a latent image on the image carrier. The developing roller is arranged to face the image carrier and develops the latent image with a developer including a carrier and a toner. The regulating member regulates a layer thickness of the developer of a surface of the developing roller. The regulating member extends in a direction approaching the developing roller. A magnetic force exerted by the developing roller at a tip end of the regulating member in an extending direction is 55 mT or less.

18 Claims, 9 Drawing Sheets

IMAGE FORMING UNIT AND IMAGE FORMING APPARATUS

FIELD

Embodiments described herein relate generally to an image forming unit and an image forming apparatus.

BACKGROUND

In the related art, there are image forming apparatuses such as a multi-function peripheral (hereinafter, referred to as an "MFP") and a printer. The image forming apparatus includes a developing device that develops a latent image on an image carrier. In recent years, in order to save energy, a developer containing a toner having a low melting point is used in a developing device in some cases.

In the image forming apparatus, the amount of developer transported in the developing device is reduced, which may affect an image.

DETAILED DESCRIPTION

Figure 1:
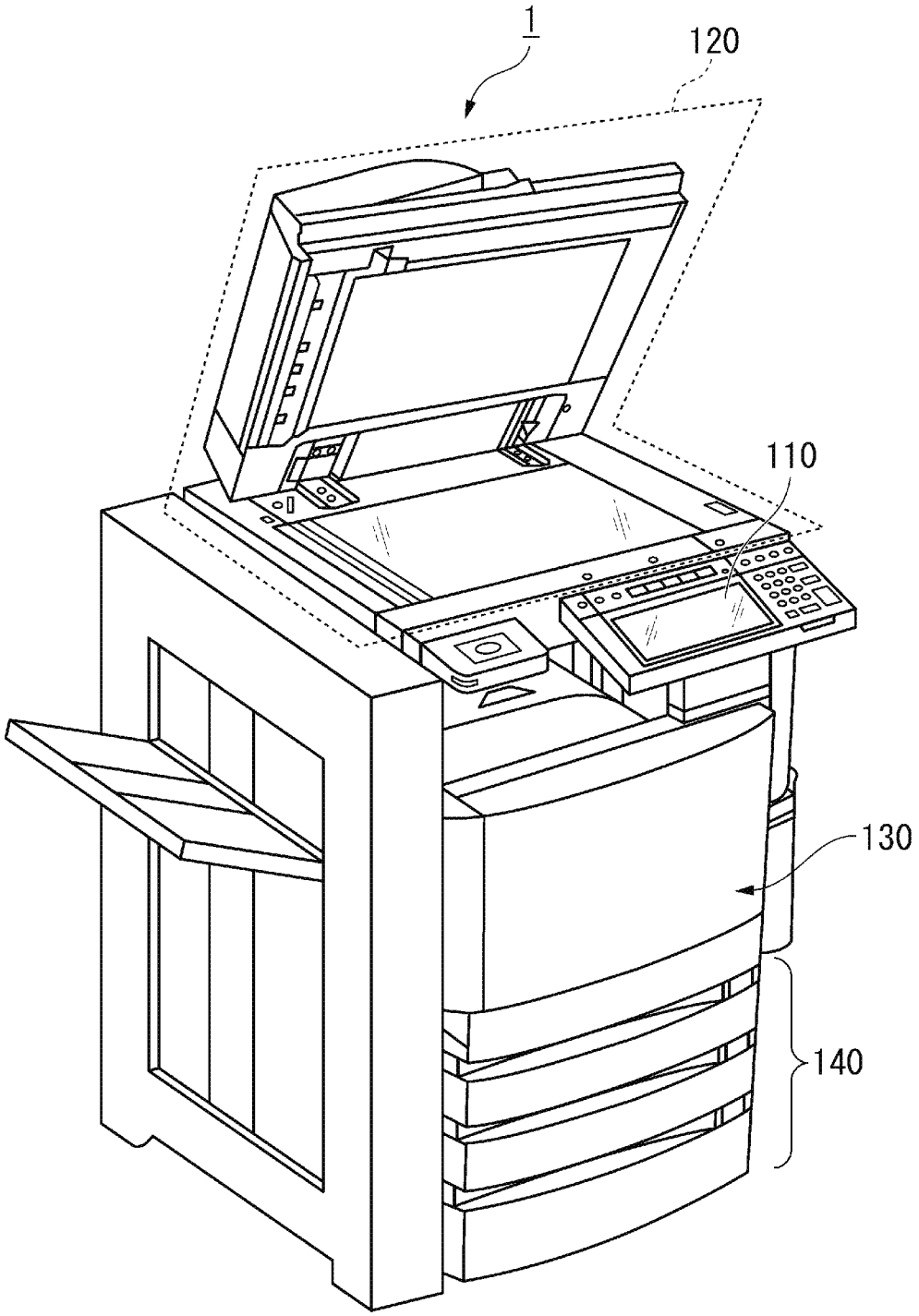
FIG. 1 is an external view showing an example of an image forming apparatus according to an embodiment.

In general, according to one embodiment, there is provided an image forming unit including: an image carrier; a charger; a latent image forming unit; a developing roller; and a regulating member. The charger charges the image carrier. The latent image forming unit forms a latent image on the image carrier. The developing roller is arranged to face the image carrier and develops the latent image with a developer including a carrier and a toner. The regulating member regulates a layer thickness of the developer of a surface of the developing roller. The regulating member extends in a direction approaching the developing roller. A magnetic force exerted by the developing roller at a tip end of the regulating member in an extending direction is 55 mT or less.

Hereinafter, an image forming unit and an image forming apparatus according to embodiments will be described with reference to the drawings. In each drawing, the same reference numerals are given to the same components. In each drawing, the dimension and shape of each member may be exaggerated or simplified for clarity.

As shown in FIG. 1, for example, an image forming apparatus 1 is an MFP (Multi-Function Peripheral), a printer, or a copier, which is a multi-function peripheral.

Hereinafter, a case where the image forming apparatus 1 is an MFP will be described as an example. The image forming apparatus 1 generates digital data (image file) by reading an image formed on a sheet-like recording medium (hereinafter, referred to as "sheet") such as paper. The image forming apparatus 1 forms an image on a sheet using toner based on digital data.

The image forming apparatus 1 includes a display unit 110, an image reading unit 120, an image forming unit 130, and a sheet tray 140.

The display unit 110 operates as an output interface and displays characters and images. The display unit 110 operates as an input interface and receives an instruction from a user. For example, the display unit 110 is a touch panel type liquid crystal display.

For example, the image reading unit 120 is a color scanner. Color scanners include a CIS (Contact Image Sensor), a CCD (Charge Coupled Device), and the like. The image reading unit 120 reads an image formed on a sheet using a sensor and generates digital data.

The image forming unit 130 forms an image on a sheet using toner. The image forming unit 130 forms an image based on image data read by the image reading unit 120 or image data received from an external device. For example, an image formed on a sheet is an output image called a hard copy, printout, and the like.

The sheet tray 140 feeds a sheet to be used for image output to the image forming unit 130.

Figure 2:
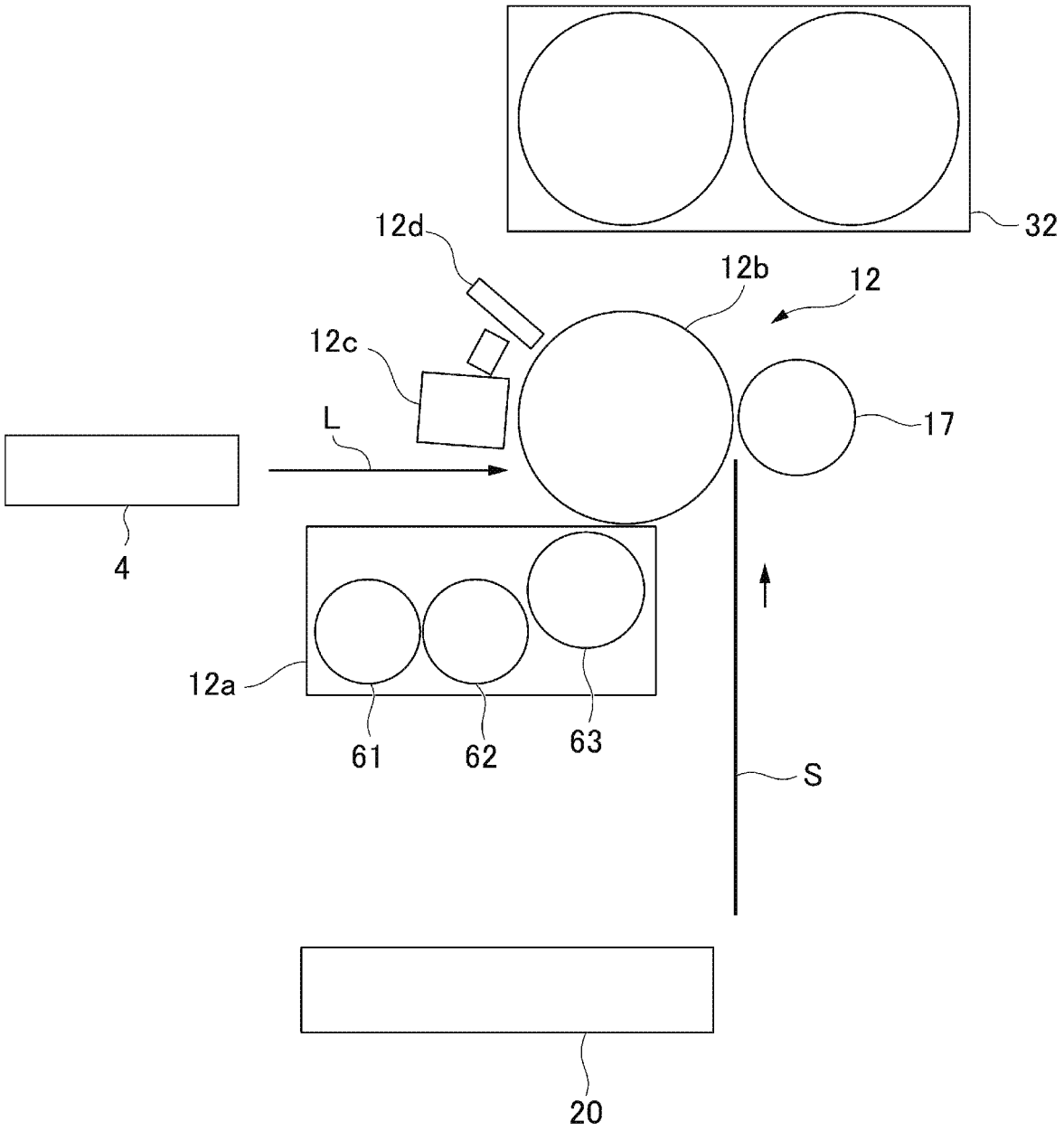
FIG. 2 is a configuration diagram schematically showing the image forming apparatus.

As shown in FIG. 2, the image forming apparatus 1 includes a scanner unit (not shown), an image processing unit (not shown), an exposure unit 4, an image forming unit 12, a transfer roller 17, a paper feeding unit 20, a fixing device 32, and a control unit (not shown).

The scanner unit reads an image formed on a sheet to be scanned. The scanner unit outputs the generated image data to the image processing unit. The image processing unit converts image data into a signal. The image processing unit controls the operation of the exposure unit 4 based on the signal.

The exposure unit 4 irradiates a photosensitive drum 12*b* of the image forming unit 12 with light. The exposure unit 4 includes an exposure light source such as a laser or an LED. The exposure unit 4 is a specific example of a latent image forming unit (latent image forming tool).

The image forming unit 12 forms an image using toner. The transfer roller 17 faces the photosensitive drum 12*b*. The transfer roller 17 transfers the image formed by the image forming unit 12 onto a sheet S. The paper feeding unit 20 feeds a sheet S. The fixing device 32 fixes the image transferred onto the sheet S to the sheet S by heating and pressing. The sheet S having the image formed thereon is discharged out of the apparatus from a sheet discharge unit (not shown).

A specific example of the image forming unit 12 of the image forming apparatus 1 of the embodiment will be described.

Figure 3:
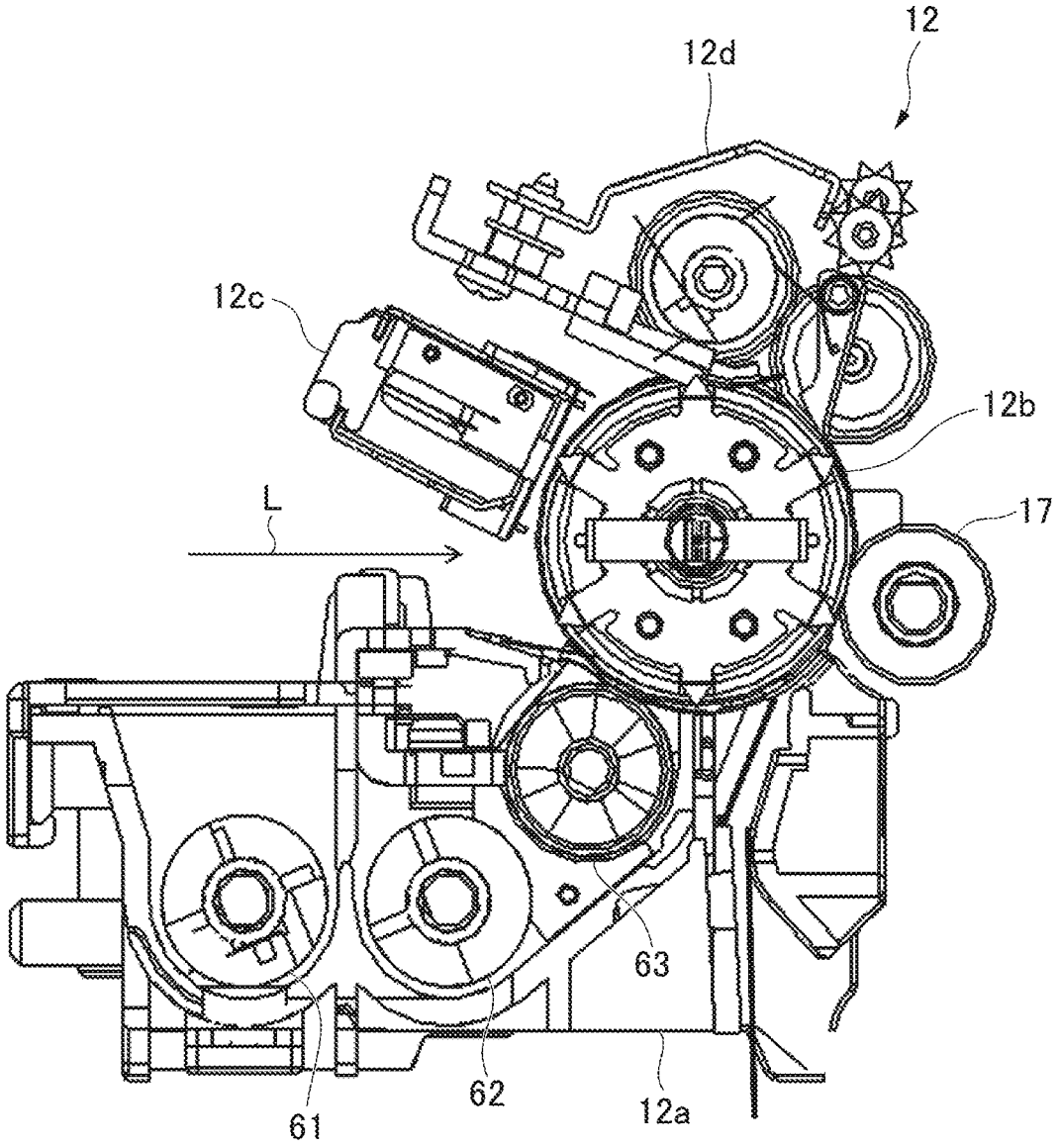
FIG. 3 is a configuration diagram of an image forming unit.

As shown in FIGS. 2 and 3, the image forming unit 12 includes a developing device 12*a*, a photosensitive drum 12*b*, a charger 12*c*, and a cleaning member 12*d*.

As shown in FIG. 3, the developing device 12*a* contains a developer. The developer includes a toner. The developing device 12*a* attaches the toner to the photosensitive drum 12*b*. For example, the toner is used as a two-component developer in combination with a carrier. For example, the carrier is a magnetic particle. For example, the magnetic particle is an iron powder or a ferrite particle having a particle diameter of several tens of μm. In the embodiment, a two-component developer including a non-magnetic toner is used.

The photosensitive drum 12*b* is a specific example of an image carrier (image carrying unit). The photosensitive drum 12*b* includes a photoreceptor (photosensitive area) on the outer peripheral surface thereof. For example, the photoreceptor is an organic photo conductor (OPC).

The charger 12*c* charges the surface of the photosensitive drum 12*b*.

The cleaning member 12*d* removes a part of the toner attached to the photosensitive drum 12*b*.

The outline of the operation of the image forming unit 12 will be described.

The photosensitive drum 12*b* is charged by the charger 12*c*. The exposure unit 4 (refer to FIG. 2) irradiates the photosensitive drum 12*b* with light L. Thus, the potential of the area irradiated with the light L in the photosensitive drum 12*b* is changed. Due to this change, an electrostatic latent image is formed on the surface of the photosensitive drum 12*b*. The electrostatic latent image of the surface of the photosensitive drum 12*b* is developed by the developer of the developing device 12*a*. That is, the image developed by the toner (hereinafter, referred to as "developed image") is formed on the surface of the photosensitive drum 12*b*.

As shown in FIG. 2, the developed image formed on the surface of the photosensitive drum 12*b* is transferred onto the sheet S by the transfer roller 17.

Figure 4:
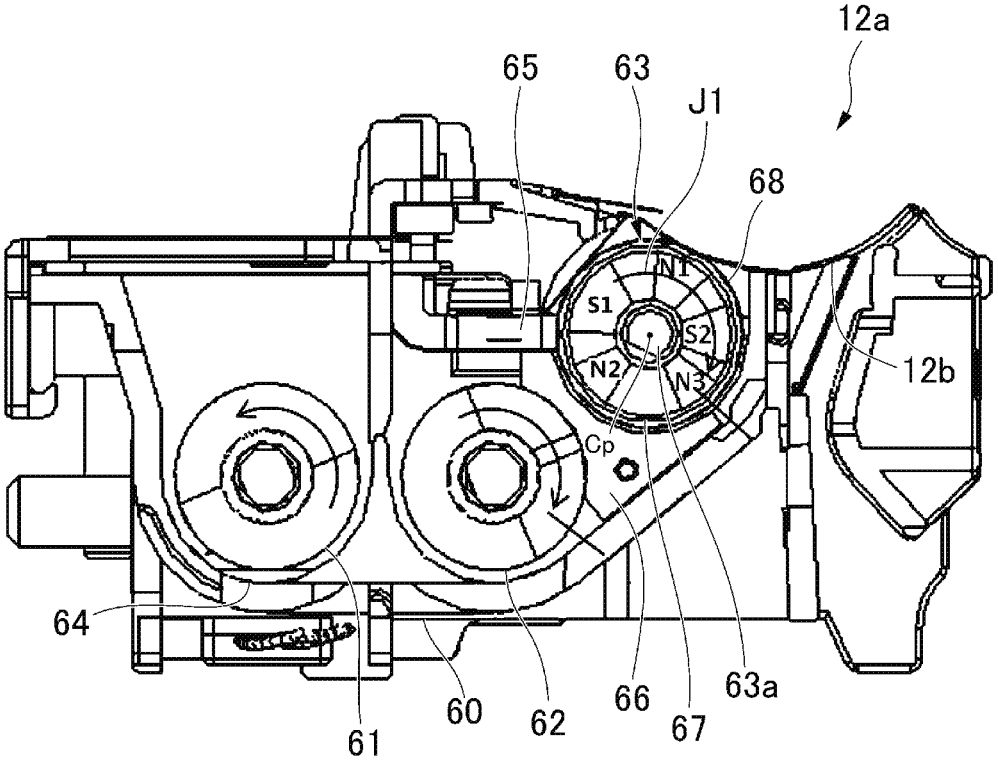
FIG. 4 is a configuration diagram of a developing device.

As shown in FIG. 4, the developing device 12*a* includes a container 60, a first mixer 61, a second mixer 62, a developing roller 63, an auto-toner sensor 64, and a layer regulating member 65. Reference numeral 66 denotes a storage unit that stores a developer.

The first mixer 61 and the second mixer 62 mix the developer in the container 60 and guide the developer to the developing roller 63.

The developing roller 63 carries the developer by a magnetic force. The developing roller 63 faces the photosensitive drum 12*b*. The developing roller 63 includes a magnet roller 67, and a developing sleeve 68. The magnet roller 67 includes a plurality of magnetic pole portions N1, S2, N3, N2, and S1. The rotation direction of the developing sleeve 68 is referred to as "rotation direction J1". Reference numeral 63*a* denotes an axial portion of the developing roller 63. Reference numeral Cp denotes a central axis Cp of the developing roller 63. The direction of the central axis Cp is referred to as the "axial direction".

The plurality of magnetic pole portions N1, S2, N3, N2, and S1 are arranged in parallel around the axis of the axial portion 63*a* in the developing sleeve 68. The magnetic pole portions N1, S2, N3, N2, and S1 include magnets. The magnetic pole portions N1, N2, and N3 are N poles. The magnetic pole portions S1 and S2 are S poles. The magnetic pole portions N1, S2, N3, N2, and S1 are arranged in parallel in the rotation direction J1 in this order. The plurality of magnetic pole portions N1, S2, N3, N2, and S1 are fixed at fixed positions. The magnetic pole portion N1 is a developing main pole.

The magnetic pole portion N1 faces the photosensitive drum 12*b*. The magnetic pole portion N1 causes the developer carried on the surface of the developing roller 63 to approach the photosensitive drum 12*b*. The magnetic pole portion N1 is arranged adjacent to the magnetic pole portion S1 on the downstream side in the rotation direction J1. At least a part of the magnetic pole portion S1 is arranged at a position facing the layer regulating member 65. The magnetic pole portion S1 contributes regulation of the layer thickness of the developer by the layer regulating member 65. The magnetic pole portion N2 functions as a gripping pole to pump up the developer.

The developing sleeve 68 has a cylindrical shape that contains the axial portion 63*a* and the magnet roller 67. For example, the developing sleeve 68 is formed of a non-magnetic material such as aluminum or stainless steel. The developing sleeve 68 can be rotated around the axis by a drive source (not shown). The developing sleeve 68 rotates clockwise (rotation direction J1) in FIG. 4. The photosensitive drum 12*b* rotates counterclockwise in accordance with the rotation of the developing sleeve 68.

The layer regulating member 65 regulates the layer thickness of the developer carried on the surface of the developing roller 63. The layer regulating member 65 is a specific example of a regulating member. The layer regulating member 65 extends in a direction approaching the developing roller 63. A tip end 65*a* of the layer regulating member 65 in the extending direction faces the outer peripheral surface of the developing roller 63 (refer to FIGS. 7 and 8).

The developer is attached in a layer on the surface (outer peripheral surface) of the developing sleeve 68 by the magnetic force of the magnetic pole portion N2. The developer is moved in the rotation direction J1 with the rotation of the developing sleeve 68 while being held on the surface of the developing sleeve 68 by the magnetic force of the magnet roller 67. The developer reaches the magnetic pole portion N1 after the layer thickness is adjusted by the layer regulating member 65 and the magnetic pole portion S1. Some of the toner included in the developer is moved from the developing roller 63 to the photosensitive drum 12*b*. The toner is attached to the electrostatic latent image on the surface of the photosensitive drum 12*b* to form a developed image on the surface of the photosensitive drum 12*b*. The developer reaches the magnetic pole portion N3 through the magnetic pole portion S2 with the rotation of the developing sleeve 68. Some of the developer is separated from the surface of the developing sleeve 68 and is recovered in the storage unit 66.

The auto-toner sensor 64 detects the toner concentration in the developer in the developing device 12*a*. The control unit (not shown) supplies toner from a toner cartridge (not shown) to the developing device 12*a* based on the detection signal from the auto-toner sensor 64. Thus, the control unit keeps the toner concentration of the developer within a certain range.

In the image forming apparatus, white stripes or white bands may be formed in the image formed on the sheet. The reason can be presumed as follows.

Figure 5:
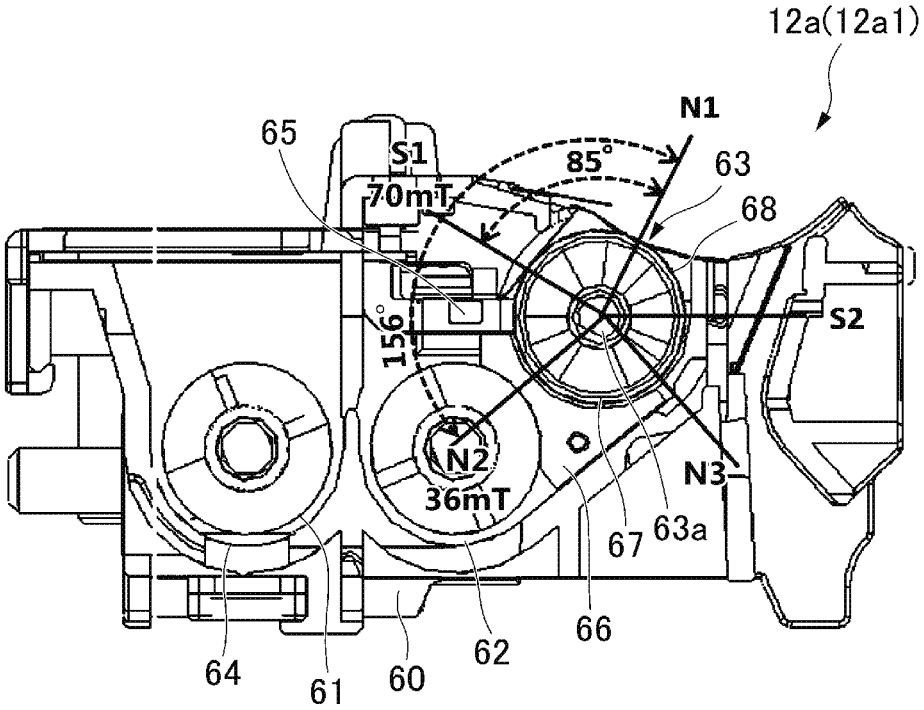
FIG. 5 is a configuration diagram of a developing device in Test Example A.

FIG. 5 is a configuration diagram of a developing device 12*a* (developing device 12*a*1) of an image forming apparatus in Test Example A. As shown in FIG. 5, in the developing device 12*a*1 of Test Example A, the magnetic force of the magnetic pole portion N2 is 36 mT. The magnetic force of the magnetic pole portion S1 is 70 mT. The angle between the magnetic pole portions N1 and N2 around the axis of the developing roller 63 is 156°. The angle between the magnetic pole portions N1 and S1 is 85°. The angle between the magnetic pole portions is determined based on the center position of the magnetic pole portions around the axis.

Figure 6:
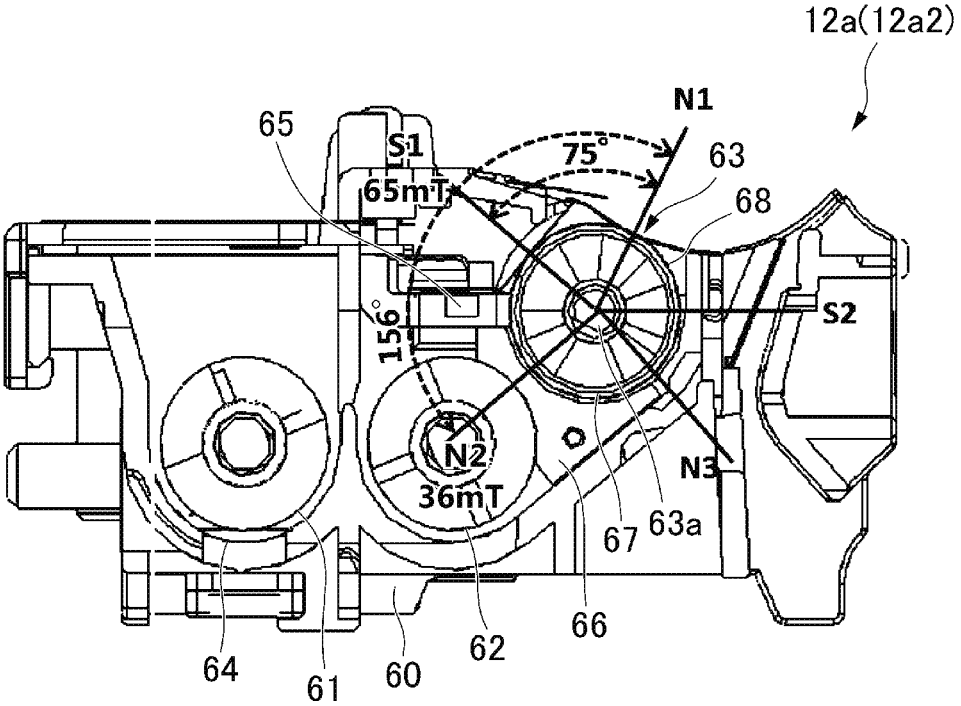
FIG. 6 is a configuration diagram of a developing device in Test Example B.

FIG. 6 is a configuration diagram of a developing device 12*a* (developing device 12*a*2) of an image forming apparatus in Test Example B. As shown in FIG. 6, in the developing device 12*a*2 of Test Example B, the magnetic force of the magnetic pole portion N2 is 36 mT. The magnetic force of the magnetic pole portion S1 is 65 mT. The angle between the magnetic pole portions N1 and N2 around the axis of the developing roller 63 is 156°. The angle between the magnetic pole portions N1 and S1 is 75°.

Figure 7:
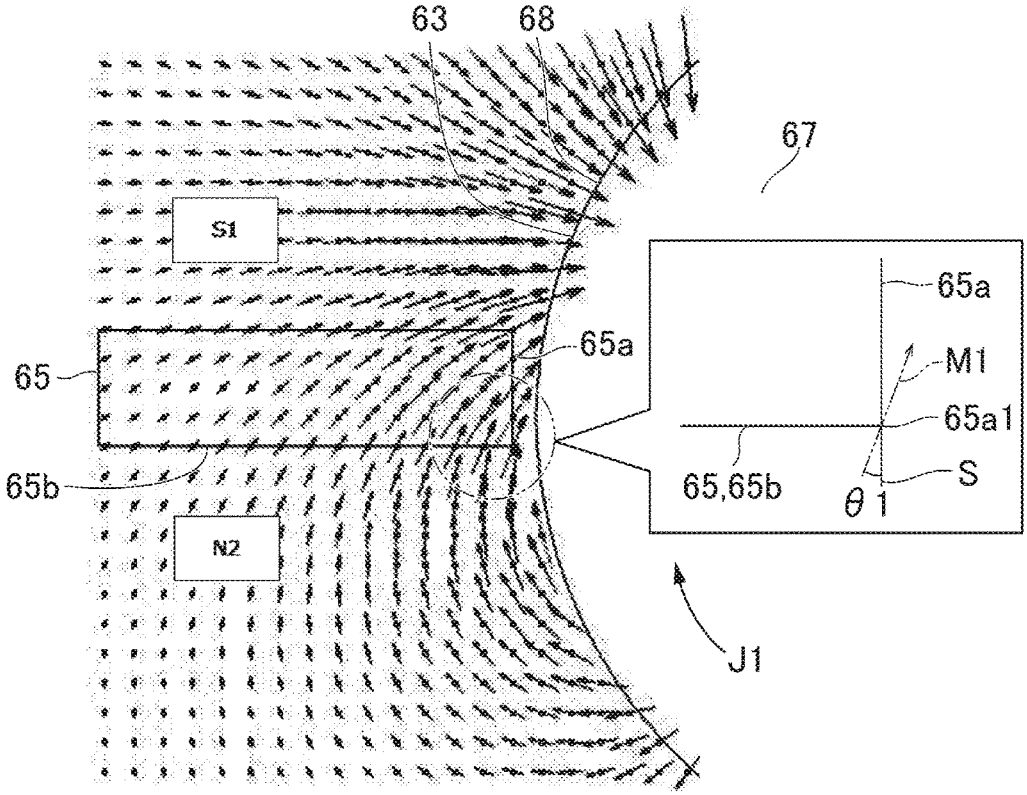
FIG. 7 is an explanatory diagram showing magnetic force lines near a layer regulating member in Test Example A.

FIG. 7 is an explanatory diagram showing magnetic force lines near the layer regulating member 65 in Test Example A (refer to FIG. 5). FIG. 7 is a diagram when viewed from a direction parallel to the central axis Cp (refer to FIG. 4) of the developing roller 63. As shown in FIG. 7, in Test Example A, at a corner portion 65*a*1 of the tip end 65*a* of the layer regulating member 65, an angle θ1 of a magnetic force line M1 with respect to a reference line S is 21°. The magnetic force at the corner portion 65*a*1 is 60 mT. The reference line S is a line along a direction perpendicular to the layer regulating member 65 (vertical direction in FIG. 7).

Figure 8:
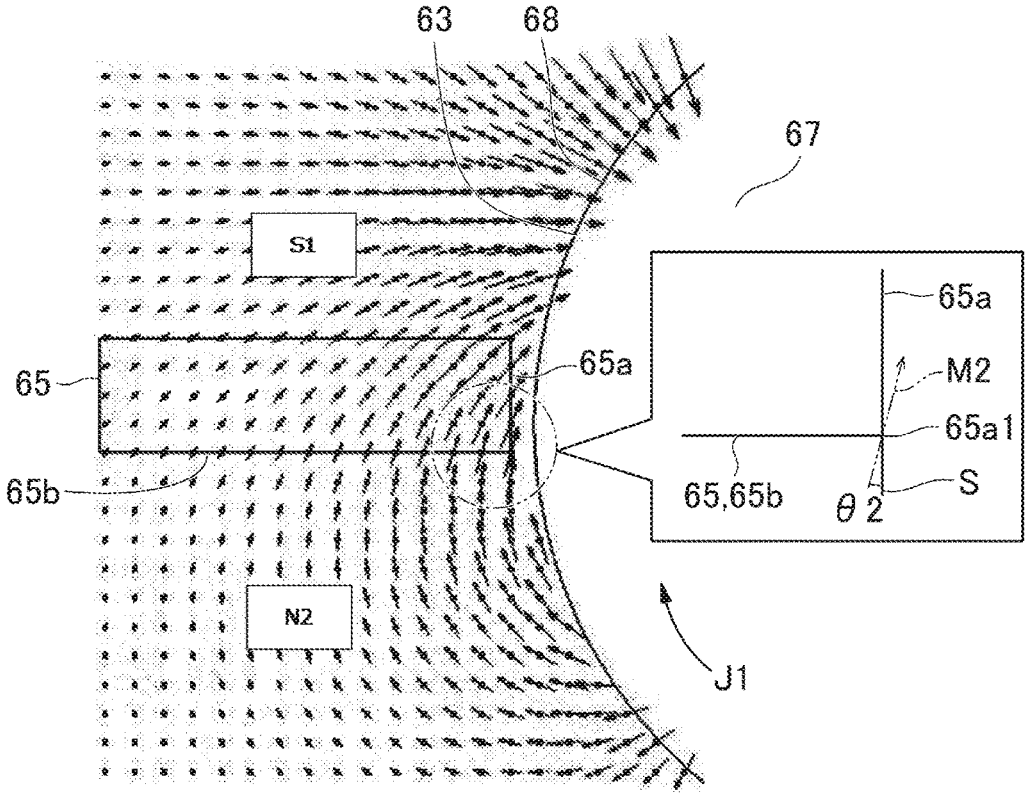
FIG. 8 is an explanatory diagram showing magnetic force lines near a layer regulating member in Test Example B.

FIG. 8 is an explanatory diagram showing magnetic force lines near the layer regulating member 65 in Test Example B (refer to FIG. 6). As shown in FIG. 8, in Test Example B, at the corner portion 65*a*1 of the tip end 65*a* of the layer regulating member 65, an angle θ2 of a magnetic force line M2 with respect to the reference line S is 15°. The magnetic force at the corner portion 65*a*1 is 45 mT.

For example, the reference line S is parallel to a tangential direction perpendicular to the radial direction and the central axis direction of the developing roller 63 at the point (closest point) on the outer peripheral surface of the developing roller 63 closest to the measurement point (the corner portion 65*a*1 of the tip end 65*a* of the layer regulating member 65). The corner portion 65*a*1 of the tip end 65*a* of the layer regulating member 65 is a corner portion of the layer regulating member 65 on a rear surface 65*b* side (the surface on the upstream side in the rotation direction J1).

Figure 9:
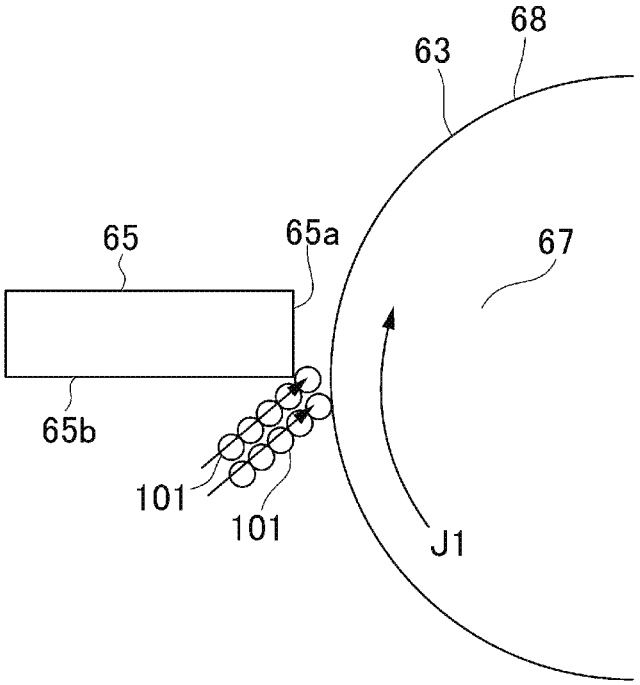
FIG. 9 is an explanatory diagram showing the behavior of a developer near the layer regulating member.
Figure 10:
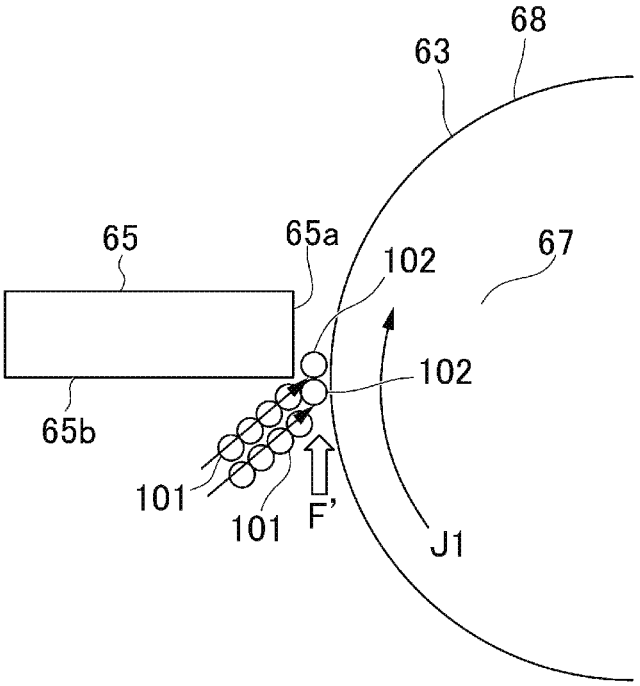
FIG. 10 is an explanatory diagram showing a behavior of the developer near the layer regulating member.
Figure 11:
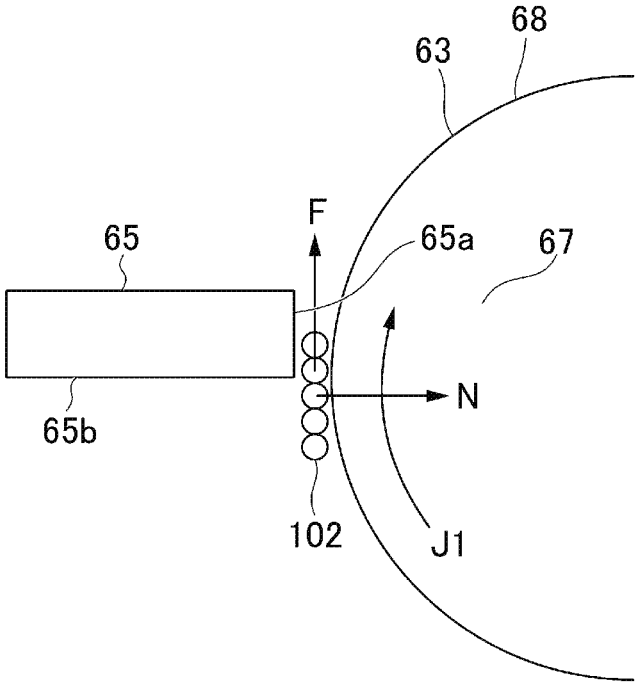
FIG. 11 is an explanatory diagram showing a behavior of the developer near the layer regulating member.

FIGS. 9 to 11 are explanatory diagrams showing the behaviors of the developer near the layer regulating member 65.

As shown in FIG. 9, near the tip end 65*a* of the layer regulating member 65, a magnetic chain 101 of the developer is formed. As shown in FIG. 10, in order for a developer 102 to pass through a gap between the layer regulating member 65 and the developing roller 63, a developer transport force F greater than a shearing force F' required to cut off the magnetic chain 101 is required. As shown in FIG. 11, a developer transport force F is expressed by a product (μN) of a friction coefficient μ of the outer surface of the developing sleeve 68 and the developer 102, and a perpendicular magnetic force N toward the central axis of the developing roller 63.

In Test Example A (refer to FIG. 5), as described above, since the magnetic force is high, the shearing force F' (refer to FIG. 10) required to cut off the magnetic chain 101 is increased. Therefore, the pressure applied to the developer on the rear surface 65*b* (refer to FIG. 10) side of the layer regulating member 65 is increased and the toner in the developer is likely to adhere to the layer regulating member 65. As the amount of adhered toner increases, the transporting amount of developer may be decreased. The decrease in the transporting amount of developer may cause white stripes or white bands described above.

On the other hand, in Test Example B (refer to FIG. 6), the magnetic force is low and the shearing force F' is decreased. Thus, the toner adhesion to the layer regulating member 65 is suppressed. However, as the number of sheets of passed paper increases, the friction coefficient μ is decreased due to the attachment of the toner component to the outer peripheral surface of the developing sleeve 68. In Test Example B, since the magnetic force is low, the perpendicular magnetic force N is low. Therefore, the transport force F may be lower than the shearing force F', and the transporting amount of developer may be decreased. The decrease in the transporting amount of developer may cause white stripes or white bands described above.

Thus, in both Test Examples A and B, there is a possibility that white stripes and white bands may be formed in the image.

In the developing device 12*a*, the following countermeasures were taken against this problem.

At the tip end 65*a* of the layer regulating member 65 (specifically, the corner portion 65*a*1), the magnetic force exerted by the developing roller 63 is 55 mT or less. Since the magnetic force is 55 mT or less, the shearing force F' (refer to FIG. 10) required to cut off the magnetic chain 101 is decreased. Therefore, the pressure applied to the developer on the rear surface 65*b* (refer to FIG. 10) side of the layer regulating member 65 is decreased and thus the toner in the developer can be prevented from being adhered to the layer regulating member 65. Since the amount of adhered toner can be reduced, a decrease in the transporting amount of developer caused by the toner adhesion can be suppressed. Since the transporting amount of developer can be secured, the occurrence of white stripes or white bands described above can be prevented.

In the developing device 12*a*, when the magnetic force is too low, the pumping amount of the developer is reduced. However, when the magnetic force is 35 mT or more, a sufficient pumping amount of developer can be obtained. Therefore, normal image formation can be performed.

Figure 12:
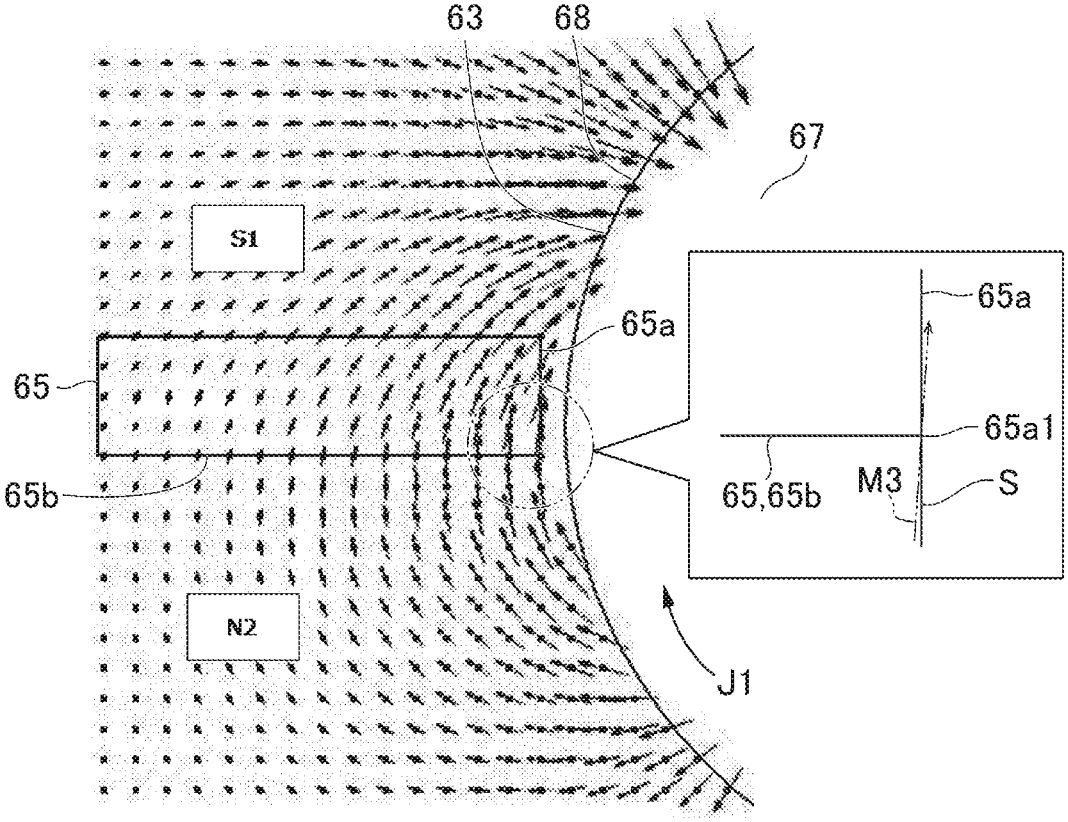
FIG. 12 is an explanatory diagram showing magnetic force lines near a layer regulating member in Test Example C.

In the developing device 12*a*, as shown in FIG. 12, the angle of the magnetic force line M3 with respect to the reference line S at the corner portion 65*a*1 of the tip end 65*a* of the layer regulating member 65 when viewed from the axial direction of the developing roller 63 is preferably 10° or less. The angle of the magnetic force line may be 5° or less, or may be 3° or less.

By setting the angle of the magnetic force line M3 to 10° or less, the direction of the magnetic force line becomes closer to the direction in which the gap between the layer regulating member 65 and the developing roller 63 is formed (developer passing direction), and thus the transport force for passing the developer through the gap can be increased. Therefore, the transporting amount of developer can be secured. Thus, the occurrence of white stripes or white bands described above can be prevented. For example, the angle of the magnetic force line can be determined by adjusting the reversal position of the magnetic force between the magnetic pole portions N2 and S1.

The angle of the magnetic force line may be −10° or more. That is, the angle of the magnetic force line may be −10° or more and 10° or less.

EXAMPLES

The developing device of Test Example A (refer to FIGS. 5 and 7), and the developing device of Test Example B (refer to FIGS. 6 and 8) were prepared. In the developing device of Test Example A, the magnetic force is 60 mT and the angle of the magnetic force line is 21°. In the developing device of Test Example B, the magnetic force is 45 mT and the angle of the magnetic force line is 15°.

(First Paper Passing Test)

A paper passing test was performed using the developing devices of Test Examples A and B. As a toner, a toner with a softening temperature of 56° C. to 60° C. was used. Continuous paper passing was performed while setting the device internal temperature (the temperature in the developing device) to 45° C. and 50° C., respectively. The number of sheets of passed paper was set to 10 k. The presence or absence of white stripes or white bands in the image formed on the sheet (paper) was examined. The results are shown in Table 1. k means 1000. For example, 1 k sheets mean 1000 sheets. 10 k sheets mean 10000 sheets.

In Table 1, "○" (Good) denotes that white stripes or white bands are not formed and a normal image is obtained. "Δ" (Fair) denotes that although white stripes or white bands are not formed in the image, soft caking (adhered matter) of the developer is formed on the rear surface 65*b* (refer to FIGS. 7 and 8) of the layer regulating member 65. "X" (Not Good) denotes that white stripes or white bands are formed in the image.

TABLE 1

| Test Example | Device Internal Temperature | Number of sheets of passed paper | | | | | | | | | |
|---|---|---|---|---|---|---|---|---|---|---|---|
| | | 1 k sheets | 2 k sheets | 3 k sheets | 4 k sheets | 5 k sheets | 6 k sheets | 7 k sheets | 8 k sheets | 9 k sheets | 10 k sheets |
| A | 45° C. | ○ | ○ | ○ | ○ | ○ | ○ | Δ | Δ | x | x |
| | 50° C. | ○ | ○ | Δ | Δ | Δ | x | x | x | x | x |
| B | 45° C. | ○ | ○ | ○ | ○ | ○ | ○ | ○ | ○ | ○ | ○ |
| | 50° C. | ○ | ○ | ○ | ○ | ○ | ○ | ○ | ○ | ○ | ○ |

○: Good,
Δ: Fair,
x: Not Good

As shown in Table 1, in Test Example A, at a device internal temperature of 45° C., the toner fixed to the layer regulating member was observed when the number of sheets was 7 k or more. When the number of sheets was 9 k or more, white stripes or white bands were formed in the image. At a device internal temperature of 50° C., when the number of sheets was 3 k or more, the toner adhesion to the layer regulating member was observed. When the number of sheets was 6 k or more, white stripes or white bands were formed in the image.

In Test Example B, at any of device internal temperatures of 45° C. and 50° C., the toner adhesion to the layer regulating member was not observed. In addition, white stripes or white bands were not formed in the image.

Thus, in Test Example B with a magnetic force of 45 mT compared to Test Example A with a magnetic force of 60 mT, even when the device internal temperature was low, white stripes or white bands were less likely to be formed in the image.

(Second Paper Passing Test)

A paper passing test was performed using the developing devices of Test Examples A and B. The number of sheets of passed paper was set to 150 k. The presence or absence of white stripes or white bands in the image formed on the sheet (paper) was examined. The device internal temperature (the temperature in the developing device) was 40° C. or less. The results are shown in Table 2.

In Table 2, "○" (Good) denotes that the developer layer is uniform, and a normal image is obtained without forming white stripes or white bands. "Δ" (Fair) denotes that the image was normal but the transporting amount of the developer is low. "X" (Not Good) denotes that the transporting amount of developer is decreased and white stripes or white bands are formed.

TABLE 2

| Test Example | Number of sheets of passed paper | | | | | | | |
|---|---|---|---|---|---|---|---|---|
| | 10 k sheets | 20 k sheets | 30 k sheets | 40 k sheets | 50 k sheets | 60 k sheets | 70 k sheets | 80 k sheets |
| A | ○ | ○ | ○ | ○ | ○ | ○ | ○ | ○ |
| B | ○ | x | x | x | x | x | x | x |

TABLE 2-continued

| Test Example | Number of sheets of passed paper | | | | | | |
|---|---|---|---|---|---|---|---|
| | 90 k sheets | 100 k sheets | 110 k sheets | 120 k sheets | 130 k sheets | 140 k sheets | 150 k sheets |
| A | ○ | ○ | Δ | Δ | Δ | Δ | Δ |
| B | x | x | x | x | x | x | x |

○: Good,
Δ: Fair,
x: Not Good

As shown in Table 2, in Test Example A, when the number of sheets was 110 k or more, the image was normal, but the transporting amount of the developer was low. In Test Example B, when the number of sheets was 20 k or more, the transporting amount of the developer was decreased and white stripes or white bands were formed in the image.

As described above, in Test Example B, when the number of sheets of passed paper was increased, white stripes or white bands were likely to be formed in the image.

(Third Paper Passing Test)

As shown in FIG. 12, a developing device having a configuration corresponding to the developing device of Test Example B was prepared except that at the corner portion 65*a*1 of the tip end 65*a* of the layer regulating member 65, the angle of the magnetic force line with respect to the reference line S was set to 1° and the magnetic force at the corner portion 65*a*1 was set to 46 mT. This developing device is referred to as C. The angle of the magnetic force line was determined by adjusting the reversal position of the magnetic force between the magnetic pole portions N2 and S1.

The developing device of Test Example C was provided for the same paper passing test as the first paper passing test. The results are shown in Table 3.

TABLE 3

| Test Example | Device: Internal Temperature | Number of sheets of passed paper | | | | | | | | | |
|---|---|---|---|---|---|---|---|---|---|---|---|
| | | 1 k sheets | 2 k sheets | 3 k sheets | 4 k sheets | 5 k sheets | 6 k sheets | 7 k sheets | 8 k sheets | 9 k sheets | 10 k sheets |
| C | 45° C. | ○ | ○ | ○ | ○ | ○ | ○ | ○ | ○ | ○ | ○ |
| | 50° C. | ○ | ○ | ○ | ○ | ○ | ○ | ○ | ○ | ○ | ○ |

○: Good,
Δ: Fair,
x: Not Good

As shown in Table 3, in Test Example C, toner adhesion, white stripes, and white bands were not observed and a normal image was able to be formed.

(Fourth Paper Passing Test)

The developing device of Test Example C was provided for the same paper passing test as the second paper passing test. The results are shown in Table 4.

TABLE 4

| Test Example | Number of sheets of passed paper | | | | | | | |
|---|---|---|---|---|---|---|---|---|
| | 10 k sheets | 20 k sheets | 30 k sheets | 40 k sheets | 50 k sheets | 60 k sheets | 70 k sheets | 80 k sheets |
| C | ○ | ○ | ○ | ○ | ○ | ○ | ○ | ○ |

TABLE 4-continued

| Test Example | Number of sheets of passed paper | | | | | | |
|---|---|---|---|---|---|---|---|
| | 90 k sheets | 100 k sheets | 110 k sheets | 120 k sheets | 130 k sheets | 140 k sheets | 150 k sheets |
| C | ○ | ○ | ○ | ○ | ○ | ○ | ○ |

○: Good,
Δ: Fair,
x: Not Good

As shown in Table 4, in Test Example C, the transporting amount of the developer was not decreased, white stripes and white bands were not formed, and a normal image was able to be formed.

From the results, it was confirmed that by setting the angle of the magnetic force line to 1°, the transporting amount of the developer was secured, and the occurrence of white stripes and white bands could be prevented.

(Fifth Paper Passing Test)

Figure 13:
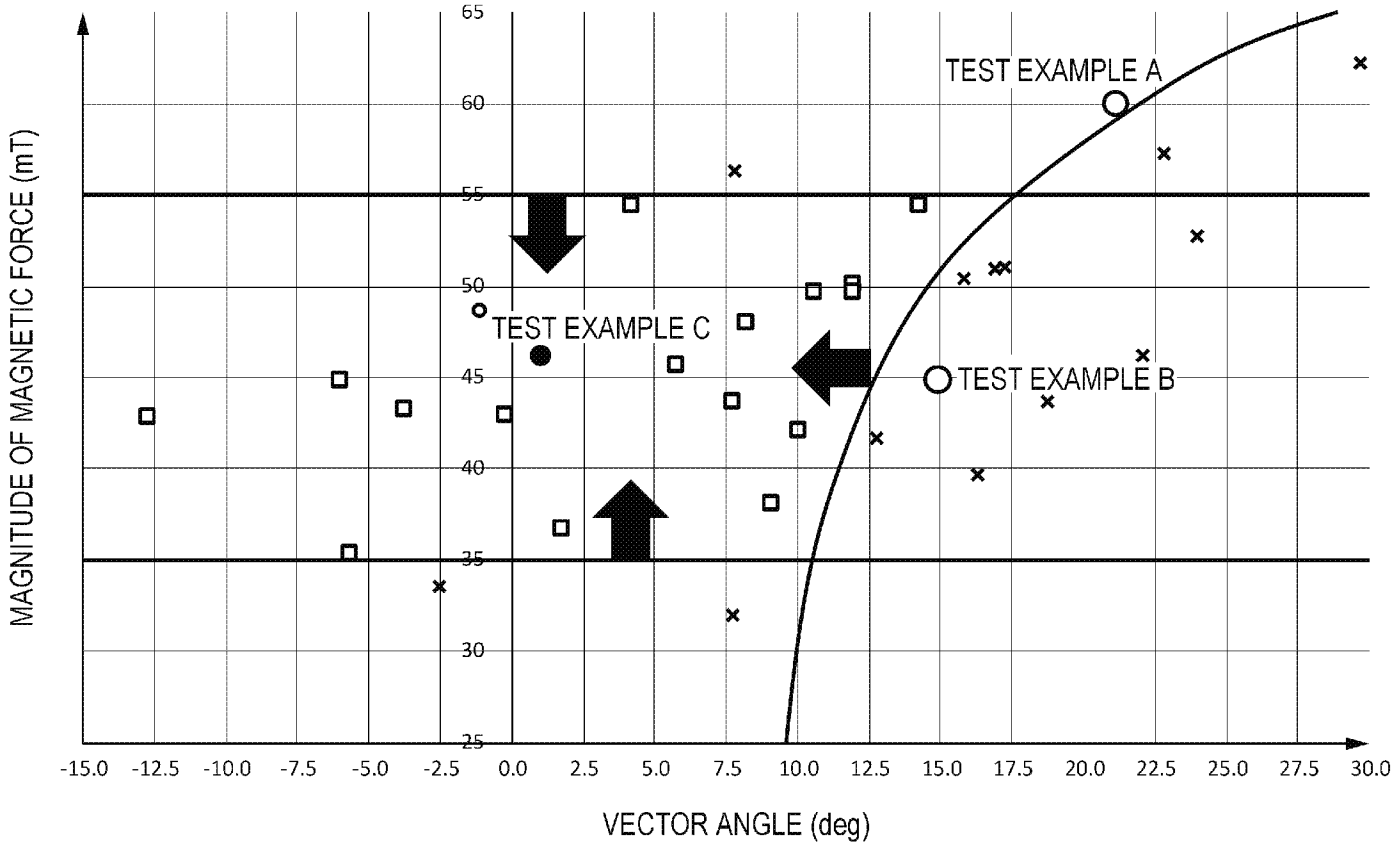
FIG. 13 is an explanatory diagram showing test results.

A plurality of developing devices having different magnetic forces or magnetic force line angles from those in Test Examples A to C were prepared, and these devices were provided for the same paper passing test as the first and second paper passing tests. The results are shown in FIG. 13. In FIG. 13, "□" indicates the condition when the occurrence of white stripes or white bands, toner adhesion to the layer regulating member and a decrease in the transporting amount of the developer do not occur. "X" indicates the condition when one of the occurrence of white stripes or white bands, toner adhesion to the layer regulating member and a decrease in the transporting amount of developer occurs.

As shown in FIG. 13, by setting the magnetic force to 55 mT or less, the toner adhesion to the layer regulating member was less likely to occur. Therefore, the occurrence of white stripes and white bands could be prevented. In addition, when the angle of the magnetic force line was 10° or less, a decrease in the transporting amount of the developer was less likely to occur. Therefore, the occurrence of white stripes and white bands could be prevented. Further, when the magnetic force was 35 mT or more, a sufficient pumping amount of the developer could be obtained and a good image could be formed.

The image forming apparatus of the embodiment can form a monochrome image using a black monochromatic toner. The image forming apparatus of the embodiment may be applicable to a color image. If the image forming apparatus is applicable to a color image, the image forming apparatus of the embodiment includes a plurality of image forming units. For example, in the plurality of image forming units, toners of yellow (Y), magenta (M), cyan (C), and black (K) are respectively used.

According to at least one of the embodiments described above, since the magnetic force is set to 55 mT or less, the toner adhesion to the layer regulating member is less likely to occur. Thus, white stripes and white bands can be prevented from being formed in the image.

With respect to any figure or numerical range for a given characteristic, a figure or a parameter from one range may be combined with another figure or a parameter from a different range for the same characteristic to generate a numerical range.

Other than in the operating examples, if any, or where otherwise indicated, all numbers, values and/or expressions referring to parameters, measurements, conditions, etc., used in the specification and claims are to be understood as modified in all instances by the term "about."

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming device, comprising:

an image carrier;

a charger configured to charge the image carrier;

a latent image forming component configured to form a latent image on the image carrier;

a developing roller positioned to face the image carrier and configured to develop the latent image with a developer comprising a carrier and a toner, wherein the toner has a softening temperature from 56° C. to 60° C.; and a regulating member configured to regulate a layer thickness of the developer of a surface of the developing roller, the regulating member extends in a direction approaching the developing roller, and a magnetic force exerted by the developing roller at a tip end of the regulating member in an extending direction is 55 mT or less.

2. An image forming device, comprising:

an image carrier;

a charger configured to charge the image carrier;

a latent image forming component configured to form a latent image on the image carrier;

a developing roller positioned to face the image carrier and configured to develop the latent image with a developer comprising a carrier and a toner; and a regulating member configured to regulate a layer thickness of the developer of a surface of the developing roller, the regulating member extends in a direction approaching the developing roller, a magnetic force exerted by the developing roller at a tip end of the regulating member in an extending direction is 55 mT or less, and an angle of a magnetic force line from the developing roller with respect to a reference line perpendicular to the extending direction of the regulating member at the tip end of the regulating member in the extending direction when viewed from an axial direction of the developing roller is 10° or less.

3. The image forming device according to claim 1, wherein the magnetic force is 35 mT or more.

4. The image forming device according to claim 1, wherein the carrier is a magnetic particle.

5. The image forming device according to claim 1, wherein the carrier is an iron powder or a ferrite particle.

6. The image forming device according to claim 1, wherein the image carrier is a photosensitive drum.

7. The image forming device according to claim 1, further comprising:

a cleaning member configured to remove a developer attached to the image carrier.

8. The image forming device according to claim 1, further comprising:

an auto-toner sensor configured to detect a toner concentration in the developer.

9. An image forming apparatus, comprising:

an image reading component;

a sheet tray; and an image forming device, comprising:

an image carrier;

a charger configured to charge the image carrier;

a latent image forming component configured to form a latent image on the image carrier;

a developing roller positioned to face the image carrier and configured to develop the latent image with a developer comprising a carrier and a toner; and a regulating member configured to regulate a layer thickness of the developer of a surface of the developing roller, the regulating member extends in a direction approaching the developing roller, a magnetic force exerted by the developing roller at a tip end of the regulating member in an extending direction is 55 mT or less, and an angle of a magnetic force line from the developing roller with respect to a reference line perpendicular to the extending direction of the regulating member at the tip end of the regulating member in the extending direction when viewed from an axial direction of the developing roller is 10° or less.

10. The image forming apparatus according to claim 9, wherein the image forming apparatus is a multifunction peripheral or a printer.

11. The image forming apparatus according to claim 9, wherein the magnetic force is 35 mT or more.

12. The image forming apparatus according to claim 9, wherein the image carrier is a photosensitive drum.

13. The image forming apparatus according to claim 9, further comprising:

a cleaning member configured to remove a developer attached to the image carrier.

14. The image forming apparatus according to claim 9, further comprising:

an auto-toner sensor configured to detect a toner concentration in the developer.

15. An image processing method, comprising:

charging an image carrier;

forming a latent image on the image carrier;

developing the latent image with a developer comprising a carrier and a toner using a developing roller positioned to face the image carrier;

regulating a layer thickness of the developer of a surface of the developing roller; and exerting a magnetic force at a tip end of a regulating member in an extending direction of 55 mT or less, wherein an angle of a magnetic force line from the developing roller with respect to a reference line perpendicular to the extending direction of a regulating member at the tip end of the regulating member in the extending direction when viewed from an axial direction of the developing roller is 10° or less.

16. The image processing method according to claim 15, wherein the magnetic force exerted is 35 mT or more.

17. The image processing method according to claim 15, further comprising:

removing a developer attached to the image carrier.

18. The image processing method according to claim 15, further comprising:

detecting a toner concentration in the developer.

* * * * *